US005379734A

United States Patent [19]

Tsunoda et al.

[11] Patent Number: 5,379,734

[45] Date of Patent: Jan. 10, 1995

[54] STARTER TO OPERATE A DECOMPRESSION MECHANISM ON AN INTERNAL COMBUSTION ENGINE

[75] Inventors: Shuhei Tsunoda, Misato; Yoshikazu Iida, Tokyo, both of Japan

[73] Assignees: Starting Industry Company Limited; Kioritz Corporation, both of Tokyo, Japan

[21] Appl. No.: 118,530

[22] Filed: Sep. 8, 1993

[30] Foreign Application Priority Data

Sep. 14, 1992 [JP] Japan ..... 4-070443[U]

[51] Int. Cl.[6] ..... F02N 17/08

[52] U.S. Cl. ..... 123/182.1; 123/105.3

[58] Field of Search ..... 123/182.1, 185.3, 185.4, 123/179.24

[56] References Cited

U.S. PATENT DOCUMENTS

| | | | |
|---|---|---|---|
| 2,947,300 | 8/1960 | Trapp | 123/182.1 |
| 3,687,124 | 8/1972 | Kolorz | 123/182.1 |
| 4,185,606 | 1/1980 | Miyata | 123/182.1 |
| 4,257,367 | 3/1981 | Fujikawa et al. | 123/182.1 |
| 5,116,287 | 5/1992 | Hironaka et al. | 123/182.1 |
| 5,211,140 | 5/1993 | Hironaka et al. | 123/65 P |

FOREIGN PATENT DOCUMENTS

| | | | |
|---|---|---|---|
| 53-149348 | 6/1991 | Japan | 123/182.1 |

*Primary Examiner*—David A. Okonsky

*Attorney, Agent, or Firm*—Wood, Phillips, VanSanten, Hoffman & Ertel

[57] ABSTRACT

An improvement in a starter of the type having a housing to be attached to an internal combustion engine and structure on the housing for rotating a crank shaft on the internal combustion engine to which the housing is attached. The improvement resides in structure for intermittently operating a decompression mechanism on the internal combustion engine to which the housing is attached as an incident of the crank shaft rotating structure being operated.

20 Claims, 4 Drawing Sheets

STARTER TO OPERATE A DECOMPRESSION MECHANISM ON AN INTERNAL COMBUSTION ENGINE

BACKGROUND OF THE INVENTION

1. Field of the Invention

This invention relates to starters for internal combustion engines and, more particularly, to a starter that is operably connected to a decompression mechanism on an internal combustion engine to controllably vary compression within the engine cylinder(s) as the starter is operated to facilitate start-up.

2. Background Art

With the high compression of internal combustion engines, a large torque is required to initiate rotation of the crank shaft. This problem is aggravated in cold weather in which the thickened engine oil inhibits cylinder and crank shaft movement.

One proposed solution to this problem is disclosed in Japanese Patent Publication No. 50-6907. As the recoil starter disclosed therein is operated, an arm on a decompression mechanism is operated, thereby establishing a communication path between the cylinder and the atmosphere. By reducing pressure within the cylinder, starting of the engine is made easier.

The principal drawback with the above structure is that with the cylinder open to the atmosphere, the likelihood of malfunction is increased; as a result of which the engine may not start.

SUMMARY OF THE INVENTION

The present invention is specifically directed to overcoming the above problem in a novel and simple manner.

In one form of the invention, an improvement is provided for a starter of the type having a housing to be attached to an internal combustion engine and structure on the housing for rotating a crank shaft on the internal combustion engine to which the housing is attached. The improvement resides in structure for intermittently operating a decompression mechanism on the internal combustion engine to which the housing is attached as an incident of the crank shaft rotating structure being operated.

Accordingly, the advantages of compression reduction are realized without introducing a potential malfunction by reason of the cylinder being placed in continued communication with the atmosphere as the starter is operated.

In one form, the crank shaft rotating structure includes a plate mounted for rotation relative to the housing. The structure for operating the decompression mechanism, in one form, includes a connecting arm mounted to the housing for movement between first and second positions, with the decompression mechanism being operated as an incident of the connecting arm moving from the first position into the second position.

The connecting arm may take a number of different forms. In one form, the connecting arm is rotatable relative to the housing in moving between the first and second positions.

The connecting arm has an actuating end configured so that the connecting arm rotates between its first and second positions in response to rotation of the plate. The plate has at least one rib and one recess, and preferably a plurality of ribs and recesses, that coact with the actuating end of the connecting arm. The ribs and recesses can be arranged in an annular shape that is centered on the plate axis of rotation.

In one form, the connecting arm is L-shaped and biased towards one of its first and second positions.

The plate, in addition to its function in association with the connecting arm, also has structure for storing a supply of starting cord. By biasing the plate in one direction of rotation, the starting cord is wrapped in a storage position, whereby pulling a first part of the cord causes the plate to rotate about its axis in a direction opposite to the one direction.

In another aspect of the invention, a starter is provided for an internal combustion engine, which starter has a housing to be attached to an internal combustion engine, with there being structure on the housing for rotating a crank shaft on the internal combustion engine to which the starter is attached. Structure is provided for operating a decompression mechanism on the internal combustion engine so as to repeatedly increase and decrease compression in a cylinder on the internal combustion engine to which the starter is attached as the starter is operated. Preferably, the connecting arm changes its position at least two times for each 360° rotation of the plate.

The invention further contemplates the starter in combination with an internal combustion engine having a decompression mechanism thereon.

The L-shaped connecting arm has first and second elongate legs and is connected to the housing so that the connecting arm rotates about the length of one of the legs in moving between its first and second positions. One of the legs moves along the ribs and recesses as the starter is operated.

To facilitate guided movement of the one leg end over the plate, the one leg end can be constructed to have a tapered surface.

DETAILED DESCRIPTION OF THE DRAWINGS

Figure 1:
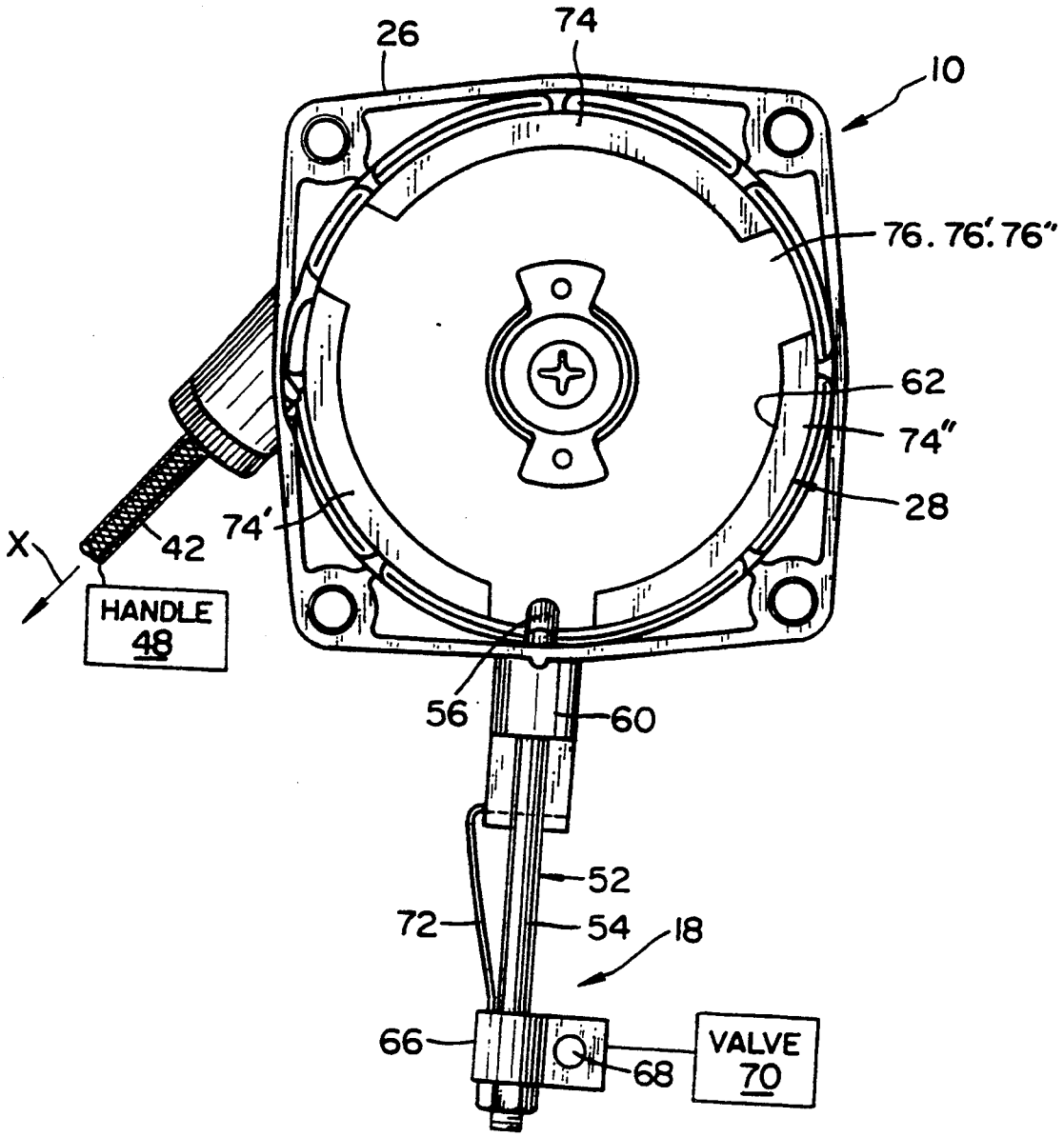
FIG. 1 is a plan view of a starter according to the present invention, with part of a recoil mechanism, normally forming a part thereof, removed.
Figure 2:
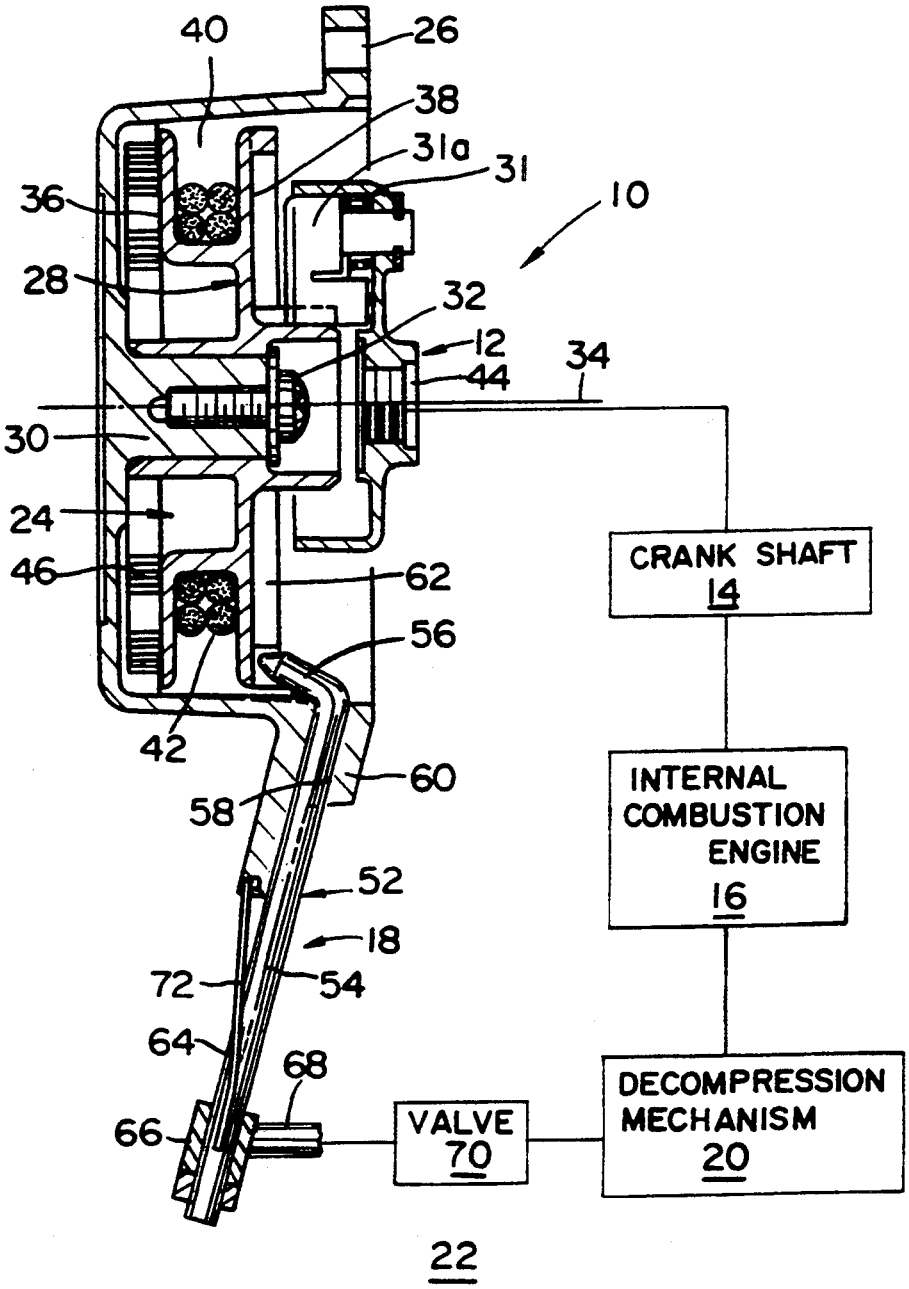
FIG. 2 is a side elevation view of the starter in FIG. 1 with the recoil mechanism thereon.

In FIGS. 1 and 2, a starter, according to the present invention, is shown at 10. The starter 10 consists of a starter means at 12 for rotating the crank shaft 14 on an internal combustion engine 16. The starter means 12 cooperates with an operating means at 18 for intermittently operating a conventional type decompression mechanism 20 which establishes communication between a cylinder, within the internal combustion engine 16, and the atmosphere 22. The starter means 12 includes a recoil mechanism 24 through which operation of the starter means 12 is effected. The means 12, 18 are carried on a housing 26.

Figure 3:
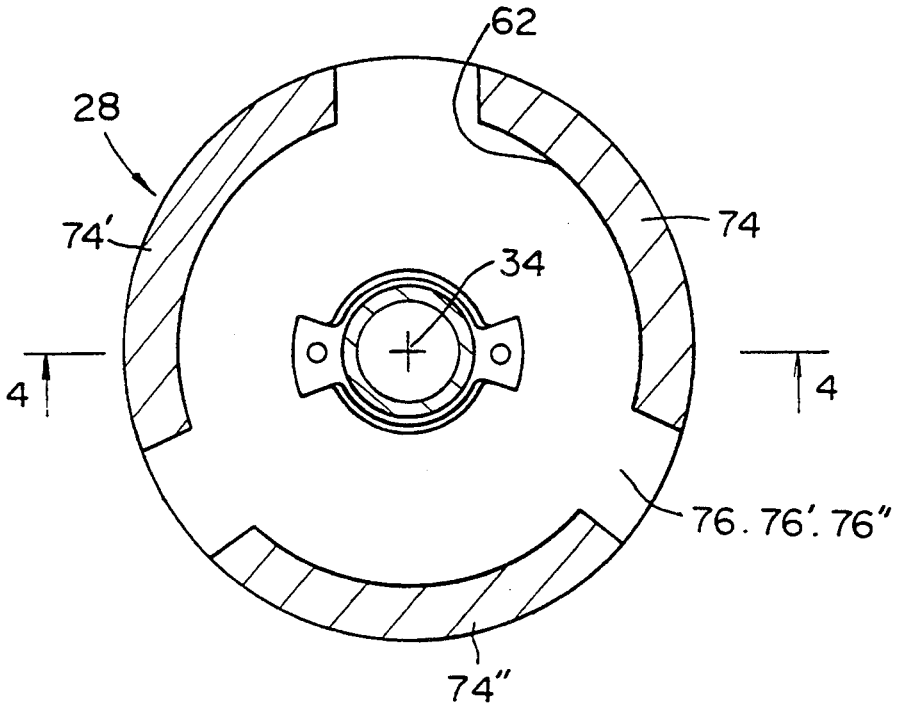
FIG. 3 is an isolated plan view of a rotatable plate on the starter for actuating a decompression mechanism.
Figure 4:
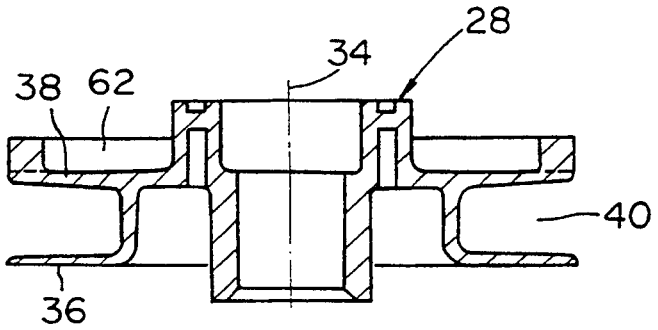
FIG. 4 is a cross-sectional view of the plate taken along line 4—4 of FIG. 3.

The recoil mechanism 24 has a plate 28, shown in detail in FIGS. 3 and 4. The plate 28 is mounted to a hub 30 in the housing 26 by a bolt 32 for rotation about an axis 34 that is coincident with the rotational axis for the crank shaft 14. The plate 28 has axially spaced flanges 36, 38 defining an annular storage space 40 for a starting cord 42.

The cord 42 is used to rotate the plate 28 about the axis 34. This in turn rotates the crank shaft 14, which is threadably connected to a hub 44 of a crank shaft end fitting 31. The plate 28 is normally biased by a spiral spring 46 in one direction of rotation about the axis 34. The spring 46 biases the plate 28 in rotation to thereby wrap the cord 42 about the plate 28 in a retracted position for the cord 42. The starter 10 is operated by drawing the cord 42 outwardly through a handle 48, which thereby effects rotation of the plate 28.

As the plate 28 is rotated at start-up, a centrifugal pawl element 31*a* associated with the crank shaft end fitting 3i is caused to engage with the plate 28 to cause the crank shaft end fitting 31 to follow rotation of the plate 28, thereby imparting rotation to the crank shaft 14. As the cord 42 is released, the crank shaft end fitting 31 disengages from the plate 28, which is driven by the spring 46 in rotation so as to rewind the cord 42 thereon.

The starter means 12 cooperates with the operating means 18 through an L-shaped connecting arm 52 on the latter. The connecting arm 52 has a long leg 54 and a shorter, actuating leg 56. The long leg 54 is guided for rotation in a bore 58 through a cylindrical extension 60 on the housing 26.

The actuating leg 56 is designed to cooperate with an adjacent wall 62 on the plate 28. An operating end 64 of the long leg 54 connects to a set plate 66, which in turn moves an operating arm 68 that is operatively connected to a control valve 70 on the decompression mechanism 20.

Figure 5:
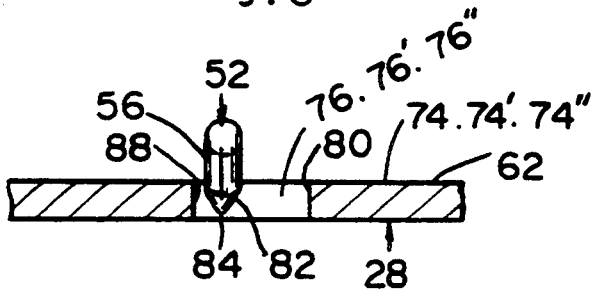
FIG. 5 is a schematic representation of the relative positions of the plate and a connecting arm between the plate and decompression mechanism prior to startup.

A torsion sping 72 acts between the connecting arm 52 and the cylindrical extension 60 to biasably maintain the connecting arm 52 in a centered position, shown schematically in FIG. 5. In the centered position for the connecting arm 52, the length of the actuating leg 56 projects substantially parallel to the axis 34 of the plate 28.

The plate 28 has alternating ribs 74, 74', 74" and receses 76, 76', 76". The ribs 74, 74', 74" and the recesses 76, 76', 76" are arranged in an annular configuration of the wall 62 that is coaxial with the plate axis 34. Prior to start-up, the actuating leg 56 resides in one of the recesses 76, 76', 76" in the centered position, as shown in FIG. 5. In the centered position for the connecting arm 52, the valve 70 on the decompression mechanism 20 is closed. As the cord 42 is pulled in the direction of th arrow X in FIG. 1, the plate 28 is rotated in a direction indicated by the arrow 78 in FIG. 6. A front corner 80 of one of the ribs 74, 74', 74" engages the actuating leg 56 and deflects the actuating leg 56 in a clockwise direction which causes the operating end 64 of the longer leg 54 on the connecting arm 52 to reposition the operating arm 68 to open the valve 70 on the decompression mechanism 20 to establish communication between the cylinder on the internal combustion engine 16 and the atmosphere 22.

Figure 7:
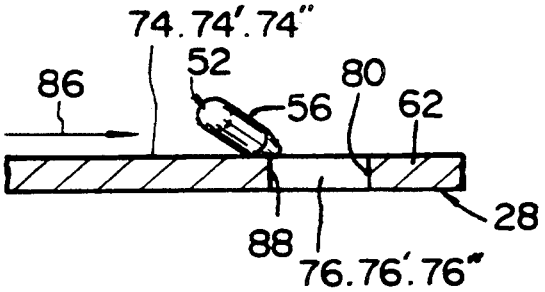
FIG. 7 is a view as in FIGS. 5 and 6 with the connecting arm being deflected as the plate is biased to rotate oppositely to its starting direction.

The actuating leg 56 has a tapered surface 82 at its free end 84 to prevent hangup between the actuating leg 56 and the ribs 74, 74', 74", particularly as the spiral spring 46 drives the plate 28 in rotation to rewind the cord 42, as indicated by the arrow 86 in FIG. 7. As the plate 28 moves in the direction of the arrow 86, the actuating leg 56 encounters a back corner 88 on the ribs 74, 74', 74" to effect counterclockwise pivoting of the actuating leg 56. The valve 70 remains closed with the plate 28 moving in a return direction, as shown in FIG. 7, since, in this direction of rotation for the connecting arm 52, the set plate 66 is caused to separate from the operating arm 68.

Figure 6:
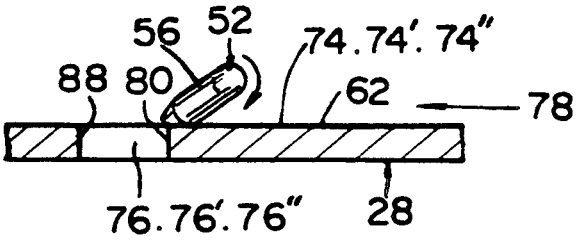
FIG. 6 is a view as in FIG. 5 with the connecting arm being deflected as the starter is operated so as to reduce cylinder compression.

With the above structure, at start-up, the actuating leg 56 is caused to be rotated clockwise as in FIG. 6 three times for each 360° revolution as it encounters the three separate ribs 74, 74', 74". Thus, the valve 70 is only momentarily, but repeatedly, opened for each revolution of the plate 28. Thus, the valve 70 opens intermittently to achieve all the benefits of decompression without increasing the likelihood of engine failure by reason of continuous communication between cylinders and the atmosphere that occurs in the prior art. At the same time, the starter 10 can be retrofit to existing, conventional units without extensive modification.

The foregoing disclosure of specific embodiments is intended to be illustrative of the broad concepts comprehended by the invention.

We claim:

1. An improved starter of the type having a housing to be attached to an internal combustion engine and rotatable means on the housing for rotating a crankshaft on an internal combustion engine to which the housing is attached and having a) an engaged state wherein rotation of the rotatable means in a first direction causes rotation in the first direction of a crankshaft on an internal combustion engine to which the housing is attached and b) a disengaged state, the improvement comprising:

first means for both activating and deactivating a decompression mechanism on an internal combustion engine to which the housing is attached as an incident of the rotatable means being in its engaged state and rotated in the first direction.

2. The improved starter according to claim 1 wherein the rotatable means includes a plate, with there being means for mounting the plate to the housing for rotation relative to the housing about an axis.

3. The improved starter according to claim 2 wherein the first means comprises a connecting arm, means for mounting the connecting arm to the housing for movement relative to the housing between first and second positions, and means for operating a decompression mechanism as an incident of the connecting arm moving from the first position into the second position.

4. The improved starter according to claim 3 wherein the means for mounting the connecting arm mounts the connecting arm for rotation relative to the housing.

5. The improved starter according to claim 3 wherein the connecting arm has an actuating end and there are means cooperating between the actuating end of the connecting arm and the plate for moving the connecting arm from the first position into the second position as the plate is rotated.

6. An improved starter of the type having a housing to be attached to an internal combustion engine and means on the housing for rotating a crankshaft on an internal combustion engine to which the housing is attached, the improvement comprising:

means for operating a decompression mechanism on an internal combustion engine to which the housing is attached as an incident of the crankshaft rotating means being operated, wherein the crankshaft rotating means includes a plate, with there being means for mounting the plate to the housing for rotation relative to the housing about an axis, wherein the decompression mechanism operating means comprises a connecting arm, means for mounting the connecting arm to the housing for movement relative to the housing between first and second positions, and means for operating a decompression mechanism as an incident of the connecting arm moving from the first position into the second position, wherein the connecting arm has an actuating end and there are means cooperating between the actuating end of the connecting arm and the plate for moving the connecting arm from the first position into the second position as the plate is rotated, wherein the cooperating means comprises at least one rib and recess on the plate that rotate with the plate, the actuating end of the connecting arm residing in a path traced by the rib and recess as the plate rotates.

7. The improved starter according to claim 6 wherein the cooperating means comprises a plurality of ribs and a plurality of recesses spaced equidistantly from the plate axis.

8. The improved starter according to claim 3 wherein the means for operating a decompression mechanism includes means cooperating between the connecting arm and housing for biasing the connecting arm to one of the first and second positions.

9. The improved starter according to claim 5 wherein the connecting arm is L-shaped.

10. The improved starter according to claim 2 wherein there are means on the plate for storing a supply of starting cord and means for biasing the plate in one direction of rotation whereby the starting cord is wrapped in a storage position, and pulling on a first part of the wrapped cord causes the plate to rotate about its axis in a direction opposite to the one direction.

11. A starter for an internal combustion engine, said starter comprising:

a housing;

means for attaching the housing to an internal combustion engine in an operative position thereon;

means on the housing for engaging and rotating a crankshaft on an internal combustion engine to which the starter is attached in a first direction; and means for operating a decompression mechanism on an internal combustion engine to which the starter is attached so as to repeatedly increase and decrease compression in a cylinder on an internal combustion engine as the rotating means engages and rotates in the first direction a crankshaft on an internal combustion engine to which the starter is attached.

12. The improved starter according to claim 11 in combination with an internal combustion engine having a decompression mechanism thereon.

13. A starter for an internal combustion engine, said starter comprising a housing;

means for attaching the housing to an internal combustion engine in an operative position thereon;

means on the housing for rotating a crankshaft on an internal combustion engine to which the starter is attached; and means for operating a decompression mechanism on an internal combustion engine to which the starter is attached so as to repeatedly increase and decrease compression in a cylinder on the internal combustion engine as the starter is operated, wherein the crankshaft rotating means comprises a plate and means for mounting the plate to the housing for rotation about an axis, wherein the decompression mechanism operating means comprises a connecting arm and means for mounting the connecting arm to the housing for movement relative to the housing between first and second positions, there being means cooperating between the connecting arm and a decompression mechanism for causing the decompression mechanism to release pressure in a cylinder as the decompression mechanism changes from a first state to a second state as an incident of the connecting arm being moved from one of its first and second positions into the other of its first and second positions, said connecting arm changing its position at least two times for each 360° rotation of the plate.

14. The improved starter according to claim 13 wherein there are means cooperating between the plate and the connecting arm for moving the connecting between one of the first and second positions into the other of the first and second positions, said means cooperating between the plate and connecting arm including an annular arrangement of ribs and recesses with there being a plurality of ribs and a plurality of recesses alternating in a circumferential direction on the plate.

15. The improved starter according to claim 13 wherein the connecting arm has an L-shaped configuration with first and second elongate legs and the connecting arm rotates about the length of one of the first and second legs as it moves between the first and second positions.

16. The improved starter according to claim 14 wherein the connecting arm has an L-shaped configuration with first and second legs and one end of one of the legs moves along the ribs and into the recesses and as an incident of the one leg end moving between a rib and recess the connecting arm moves from one of the first and second positions into the other of the first and second positions.

17. The improved starter according to claim 13 including means on the housing for biasing the connecting arm to one of the first and second positions.

18. The improved starter according to claim 16 wherein the one leg end has a tapered surface to facilitate guided movement thereof over the plate.

19. The improved starter according to claim 14 wherein the annular arrangement of ribs and recesses is coaxial with the plate axis.

20. The improved starter according to claim 11 wherein the crankshaft rotating means comprises a cord that can be wrapped on the plate around the plate axis and means for normally biasing the plate in one direction of rotation to wrap the cord around the plate.

* * * * *